US009640343B2

(12) United States Patent
Koch

(10) Patent No.: US 9,640,343 B2
(45) Date of Patent: May 2, 2017

(54) HAND-SWITCH ARRANGEMENT FOR AN ADJUSTABLE SEATING FURNITURE, ADJUSTABLE SEATING FURNITURE AND ASSEMBLY METHOD FOR AN ADJUSTABLE SEATING FURNITURE

(71) Applicant: LOGICDATA Electronic & Software Entwicklungs GmbH, Deutschlandsberg (AT)

(72) Inventor: Walter Koch, Schwanberg (AT)

(73) Assignee: LOGICDATA ELECTRONIC & SOFTWARE ENTWICKLUNGS GMBH, Deutschlandsberg (AT)

( * ) Notice: Subject to any disclaimer, the term of this patent is extended or adjusted under 35 U.S.C. 154(b) by 189 days.

(21) Appl. No.: 14/187,906

(22) Filed: Feb. 24, 2014

(65) Prior Publication Data

US 2014/0306505 A1 Oct. 16, 2014

Related U.S. Application Data

(60) Provisional application No. 61/818,394, filed on May 1, 2013.

(30) Foreign Application Priority Data

Apr. 12, 2013 (EP) ..... 13163574

(51) Int. Cl.
*H01H 13/14* (2006.01)
*H01H 9/02* (2006.01)
(Continued)

(52) U.S. Cl.
CPC ..... *H01H 9/0207* (2013.01); *A47C 1/02* (2013.01); *A47C 1/0242* (2013.01);
(Continued)

(58) Field of Classification Search
CPC .. H01H 13/14; H01H 2221/044; H01H 13/04; H01H 13/10; H01H 13/86;
(Continued)

(56) References Cited

U.S. PATENT DOCUMENTS 3,103,082 A * 9/1963 Baermann ..... 5/655.6
5,817,997 A * 10/1998 Wernig ..... 200/16 R
(Continued)

FOREIGN PATENT DOCUMENTS

DE 202006006238 U1 6/2006
WO 2012/160106 A1 11/2012

*Primary Examiner* — Edwin A. Leon
*Assistant Examiner* — Ahmed Saeed
(74) *Attorney, Agent, or Firm* — McDermott Will & Emery LLP

(57) ABSTRACT

A hand-switch arrangement (HSA) for an adjustable seating furniture (SF), in particular a recliner, the hand-switch arrangement (HSA) comprising an operating unit (OU) and a carrier module (CM). The carrier module (CM) comprises a body part (BP) with an opening (O) for accommodating the operating unit (OU). The carrier module (CM) is designed to be mechanically fixed to a rigid part (RP) of the adjustable seating furniture (SF). The operating unit (OU) comprises a control panel (CP) for controlling a drive unit (DU) of the adjustable seating furniture (SF). The operating unit (OU) further comprises a locking means (LM1) and the carrier module (CM) comprises a mating locking means (LM2) for engaging the locking means (LM1) of the operating unit (OU) when the operating unit (OU) is inserted into the opening (O) of the carrier module (CM), wherein a mounting depth of the operating unit (OU) is adjustable.

20 Claims, 4 Drawing Sheets

Figure 1:
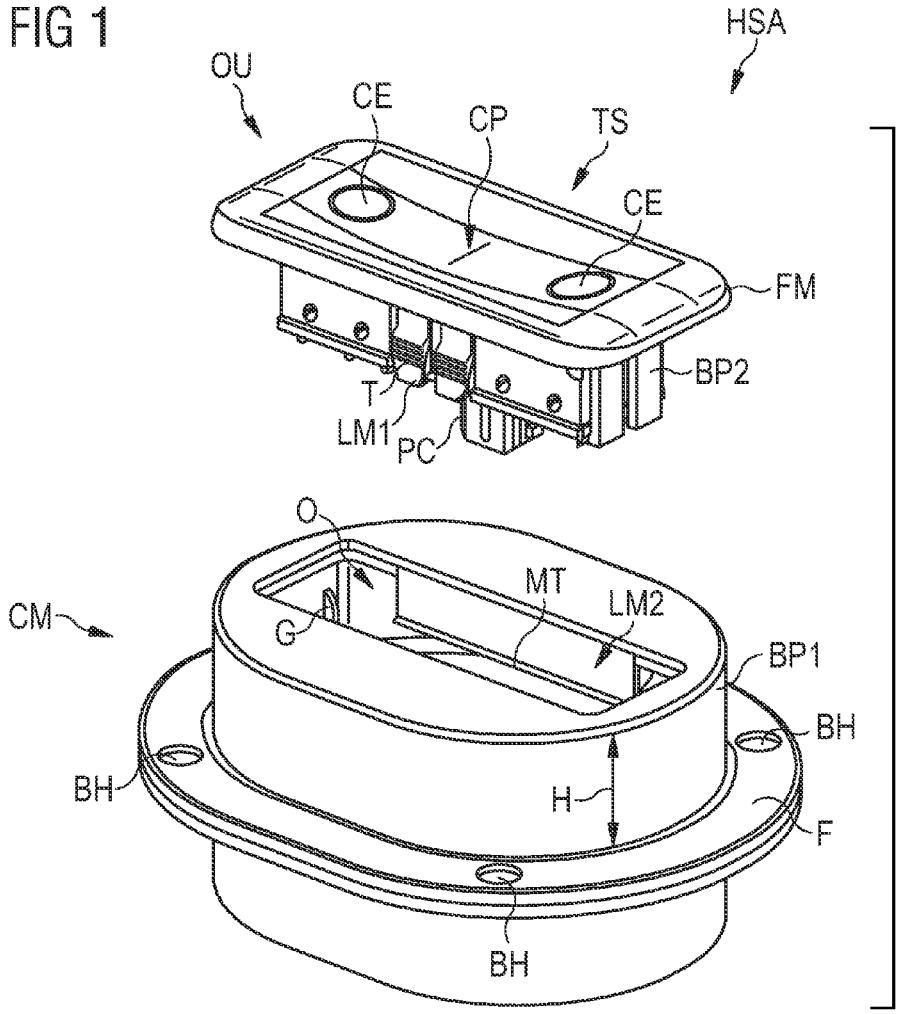

(51) Int. Cl.

| | |
|---|---|
| ***A47C 1/024*** | (2006.01) |
| ***A47C 1/032*** | (2006.01) |
| ***A47C 7/62*** | (2006.01) |
| ***A47C 7/72*** | (2006.01) |
| ***A47C 1/02*** | (2006.01) |

(52) U.S. Cl.
CPC ..... *A47C 1/03211* (2013.01); *A47C 7/62* (2013.01); *A47C 7/72* (2013.01); *Y10T 29/49826* (2015.01)

(58) Field of Classification Search
CPC ..... H01H 25/065; A47C 1/02; A47C 1/0242; A47C 7/62; A47C 1/0355; A47C 1/0345; A47C 1/035; A47C 1/03211; Y10T 24/3683; Y10T 24/3685
USPC ..... 200/43.15, 236, 345, 341; 24/114.3, 24/114.4
See application file for complete search history.

(56) References Cited

U.S. PATENT DOCUMENTS

| | | | | |
|---|---|---|---|---|
| 6,313,404 | B1* | 11/2001 | Yu | 174/58 |
| 2010/0126838 | A1* | 5/2010 | Lee | 200/339 |
| 2011/0198894 | A1* | 8/2011 | Hsieh et al. | 297/68 |
| 2012/0152710 | A1* | 6/2012 | Liu | H01H 13/14 200/341 |

* cited by examiner

HAND-SWITCH ARRANGEMENT FOR AN ADJUSTABLE SEATING FURNITURE, ADJUSTABLE SEATING FURNITURE AND ASSEMBLY METHOD FOR AN ADJUSTABLE SEATING FURNITURE

CROSS REFERENCE TO RELATED APPLICATIONS

The present application claims the benefit of U.S. Provisional Patent Application Ser. No. 61/818,394, filed on May 1, 2013, and claims priority to European Patent Application No. 13163574.0, filed on Apr. 12, 2013, both disclosures of which are hereby incorporated by reference in their entirety for all purposes.

DESCRIPTION

The invention relates to a hand-switch arrangement for an adjustable seating furniture, in particular a recliner. The invention further relates to an adjustable seating furniture with such a hand-switch arrangement and an assembly method for an adjustable seating furniture with such a hand-switch arrangement.

Nowadays adjustable seating furnitures, in particular electrically adjustable seating furnitures, are commonly used. For example, seating furnitures like chairs or armchairs are offered, where an inclination of a backrest can be electrically adjusted. In addition to displacement motors and a control system to control these motors, operating units are provided to a user, which enable the user of the seating furniture to adjust settings, e.g. the inclination of the backrest, according to his preferences. Such operating unit is normally integrated into the seating furniture, in order to be accessible for the user. As an alternative, such an operating unit can also be arranged at distance to the seating furniture, so that the operating unit can be individually positioned. The operating unit is normally connected to the control system, which for example comprises a circuit board, a microprocessor and/or logic elements.

One object to be solved by the present invention is to specify an improved concept for an operating unit that allows a more flexible usage of the operating unit and an easy assembly and/or disassembly and that safes time during assembling and/or disassembling.

The object is solved with the subject of the independent claims. Configurations and refinements of the invention are the subject matter of the dependent claims.

The proposed concept is based on the idea of providing a hand-switch arrangement for adjustable seating furniture comprising an operating unit and a carrier module. The carrier module is configured to be mechanically fixed to the seating furniture, for example from inside the seating furniture and acts as a carrier for the operating unit. The operating unit can be easily connected to adjusting motors and an energy source and inserted into the module carrier. Thus, the new concept provides a simplified mounting and/or dismounting of the operating unit, for example if the operating unit needs to be exchanged due to breakdown. The concept allows a more flexible installation and also safes time during mounting of a seating furniture. Additionally, the operating unit can be mounted and/or dismounted without the need of tools. In particular, a mounting depth of the operating unit is adjustable. For example, the concept proposes a hand-switch arrangement, which is independent from a thickness or a kind of a fabric covering the seating furniture.

According to a first aspect of the proposed concept a hand-switch arrangement for an adjustable seating furniture, in particular a recliner, is disclosed, wherein the hand-switch arrangement comprises an operating unit and a carrier module. The carrier module comprises a body part with an opening for accommodating the operating unit. The module carrier is designed to be mechanically fixed to a rigid part of the adjustable seating furniture. The operating unit comprises a control panel for controlling a drive unit of the adjustable seating furniture. The operating unit further comprises locking means and a carrier module comprises mating locking means for engaging with the locking means of the operating unit when the operating unit is inserted into the opening of the carrier module, wherein a mounting depth of the operating unit is adjustable.

For example, the rigid part of the adjustable seating furniture can be an arm rest, a side part or a console (arranged between two seating furnitures linking them) of the seating furniture.

In different embodiments, the locking means of the operating unit comprise latching means and the mating locking means of the carrier module comprise counter latching means. This facilitates a simplified mounting and dismounting of the operating unit to the carrier module, wherein the operating unit is mechanically fixed to the carrier module.

In different embodiments, the latching means comprise at least two teeth and the counter latching means comprise at least one mating tooth for engaging with the at least two teeth, so that a mounting depth is adjustable. This allows an easy assembly of the operating unit within the carrier module, wherein the operating unit snaps in with one tooth of the at least two teeth and is tightly locked to the carrier module. By providing at least two teeth it is possible to adjust a mounting depth of the operating unit. The mounting depth for example needs to be adjusted to a thickness of a fabric, which is arranged on an outside of the adjustable seating furniture. For example a leather fabric has a higher thickness than a thin linen fabric.

In different embodiments, the operating unit comprises a plug connector at an outer face, which is opposite to the control panel, wherein the plug connector is designed to be electrically connected to both a drive unit of the adjustable seating furniture and an energy source for powering the operating unit and the drive unit, in particular with a single plug. For example, the outer face is the backside of the operating unit. This facilitates that a cable with one, in particular single, plug, which is connected to the drive unit as well as to an energy source of the seating furniture for powering the operating unit and the drive unit, can be connected to the one plug connector of the operating unit. Thus, a simplified arrangement with only one plug and one plug connector respectively is needed. This allows an easy electrical arrangement and assembly of the operating unit without the need of a control system, for example. Additionally, by providing the plug connector at the backside of the operating unit, an easy service from outside the seating furniture is possible. For example, it is not necessary to over-rev the seating furniture, in order to remove and/to insert the operating unit due to repair purposes.

In different embodiments, the control panel is designed to directly provide a voltage from an energy source to a drive unit of the adjustable seating furniture, when the control panel is actuated. This facilitates that an easy embodiment of the operating unit can be achieved, since the control panel is designed to directly switch a voltage from the energy source to the drive unit of the adjustable seating furniture. For example, this can be achieved by providing switches like micro switches, which are activated by actuating the control panel.

In different embodiments, the control panel comprises a three-position switch, in particular a rocker switch, so that a rotating direction of the drive unit is adjustable. One position of the three-position switch may be a neutral position, in which no voltage from an energy source is provided to the drive unit. The remaining two positions of the switch may simply adjust the rotating direction of the drive unit, e.g. by inverting the voltage provided to the drive unit. This allows a simple and space saving arrangement of the operating unit. Additionally, such a hand-switch arrangement can also be produced at lower cost.

In different embodiments, the control panel comprises at least one control element, wherein the at least one control element comprises electrical lighting, in particular one or several LEDs. Such an electrical lighting, for example, can signal that the operating unit is correctly connected to an energy source. Such an electrical lighting can also signal to a user the position of the at least one control element, if the seating furniture is positioned in a dark environment. Also erroneous behavior of the seating furniture, for example a failure of the drive unit, can be signalized.

In different embodiments, the control panel is surrounded by a flexible material, in particular elastomer material. This allows an easy disassembly of the operating unit. For example, the flexible material can be displaced or bent over, so that an easy access is achieved to the locking means of the operating unit and/or to the mating locking means of the carrier module.

In different embodiments, the body part of the carrier module comprises a flange. This allows an easy and safe mechanical fixing of the carrier module to a rigid part of the seating furniture.

According to a second aspect of the proposed concept an adjustable seating furniture, in particular a recliner, with a hand-switch arrangement according to the first aspect of the proposed concept is disclosed. The seating furniture comprises an energy source, in particular a battery or a power supply for providing a DC-voltage, and a drive unit, in particular an electric motor, which are arranged within the seating furniture and electrically coupled to the operating unit via one common cable. The seating furniture comprises a recess in a rigid part, in which a carrier module is inserted and to which the carrier module is mechanically fixed. The operating unit is inserted into the opening of the carrier module and mechanically fixed thereto. A mounting depth of the inserted operating unit is adjustable.

The adjustable seating furniture according to the second aspect of the proposed concept essentially has the same advantages as indicated above.

In different embodiments, the seating furniture further comprises at least one fabric for covering the seating furniture. The opening of the carrier module is at least partially covered by the at least one fabric. At least one portion of the at least one fabric is arranged at least partially between the operating unit and the carrier module.

The mounting depth of the inserted operating unit is determined by a thickness of the at least one fabric.

According to a third aspect of the proposed concept an assembly method for an adjustable seating furniture with a hand-switch arrangement according to the first aspect of the proposed concept is disclosed. The assembly method comprises the following steps:

inserting the carrier module into a recess of a rigid part of the seating furniture;

mechanically fixing the carrier module to the seating furniture;

inserting the operating unit into the opening of the carrier module; and mechanically fixing the operating unit to the carrier module such that a mounting depth of the operating unit adjustable.

The assembly method according to the third aspect of the proposed concept essentially provides the same advantages as indicated above. In particular, with this assembly method an easy and simplified mounting of an operating unit and a carrier module to an adjustable seating furniture is achieved. For example, an exchange of the operating unit, e.g. due to a failure, can be achieved without disassembling the carrier module. The assembly method guarantees time saving during mounting or dismounting of the hand-switch arrangement, which consequently safes costs during production. The mounting or dismounting of the hand-switch arrangement can happen without the need of additional tools.

In different embodiments, the seating furniture is covered with at least one fabric before inserting the operating unit into the opening of the carrier module. Further, the mounting depth of the operating unit is determined by a thickness of the at least one fabric. Hence, the seating furniture can be covered with different kinds of fabrics, which may comprise different thicknesses.

In different embodiments an opening is provided in the at least one fabric over the opening of the carrier module, in particular by cutting a slid into the at least one fabric or by removing a portion of the at least one fabric. Thus, the operating unit can easily be inserted into the opening of the carrier module. For example with respect to a thick and maybe stiff fabric material like leather, it can be necessary to remove a portion of the fabric. In contrast, with respect to a thin fabric material like linen, it might be sufficient to cut a slid into the fabric over the opening of the carrier module, so that the operating unit can be inserted into the opening.

In different embodiments, a plug, in particular a single plug, of a common cable, which is connected to both a drive unit and an energy source of the seating furniture, is connected to a connector plug of the operating module before inserting of the operating unit into the opening of the carrier module. This allows an easy and flexible mounting of the operating unit within the carrier module. The operating unit can simply be connected to the drive unit and the energy source and after that inserted into the opening of the carrier module. This guarantees a very easy and quick mounting or dismounting procedure.

Exemplary embodiments of the invention are explained in the following with the aid of schematic drawings and reference numbers. Identical reference numbers designate elements or components with identical functions. In so far as elements or components corresponds to one another in function, description of them will not be repeated in each of the following figures.

Figure 2:
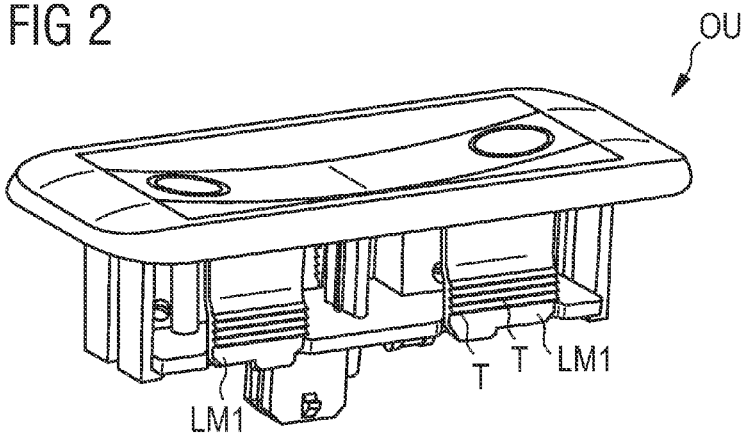
Figure 3:
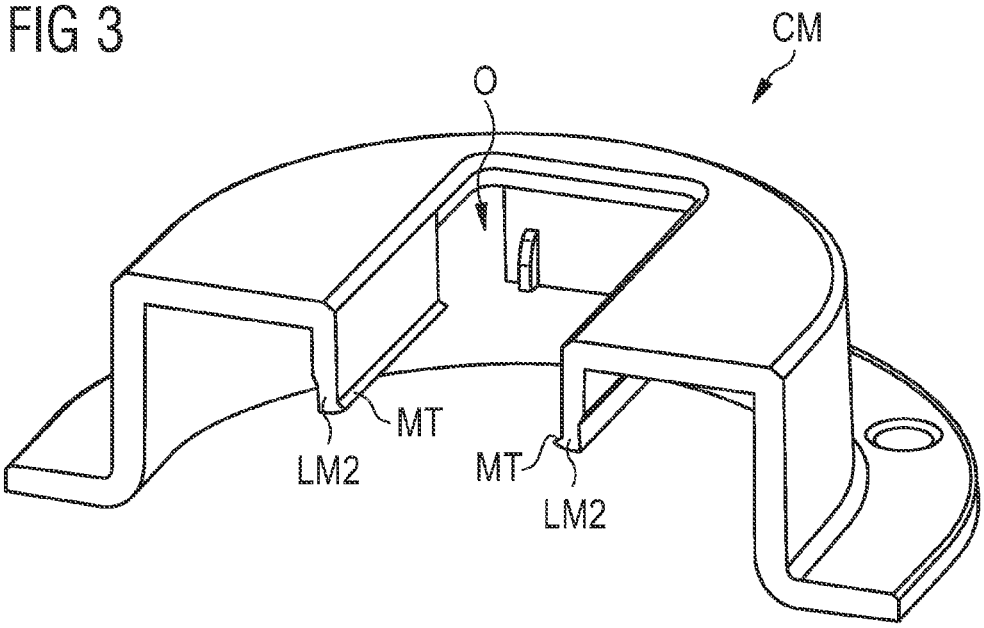
Figure 4:
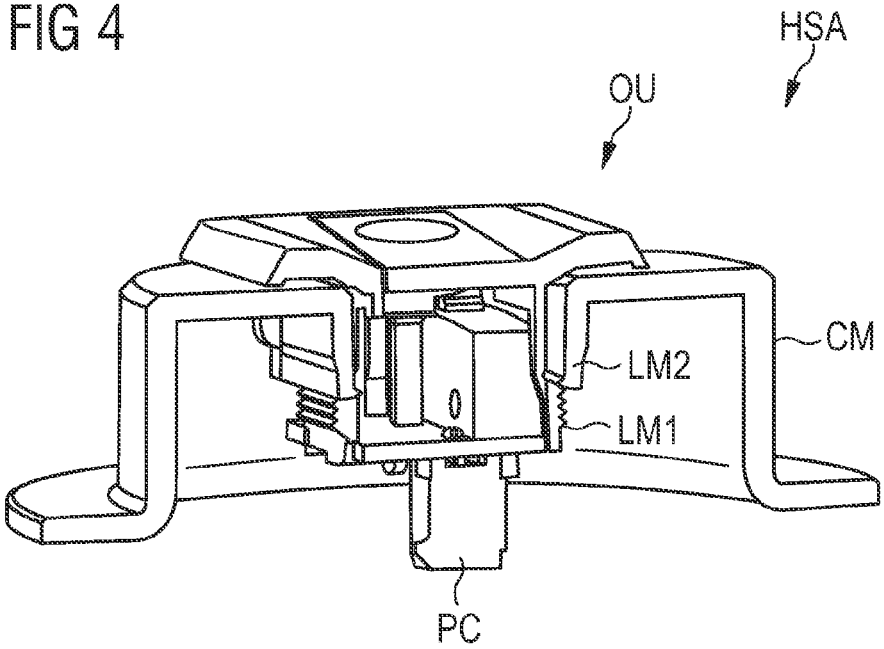
Figure 5:
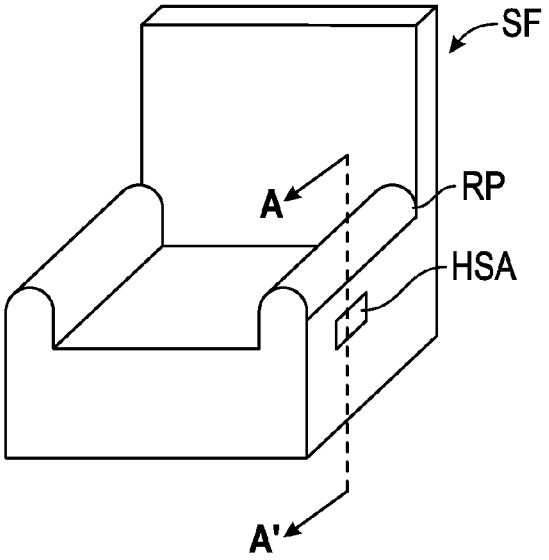
Figure 6:
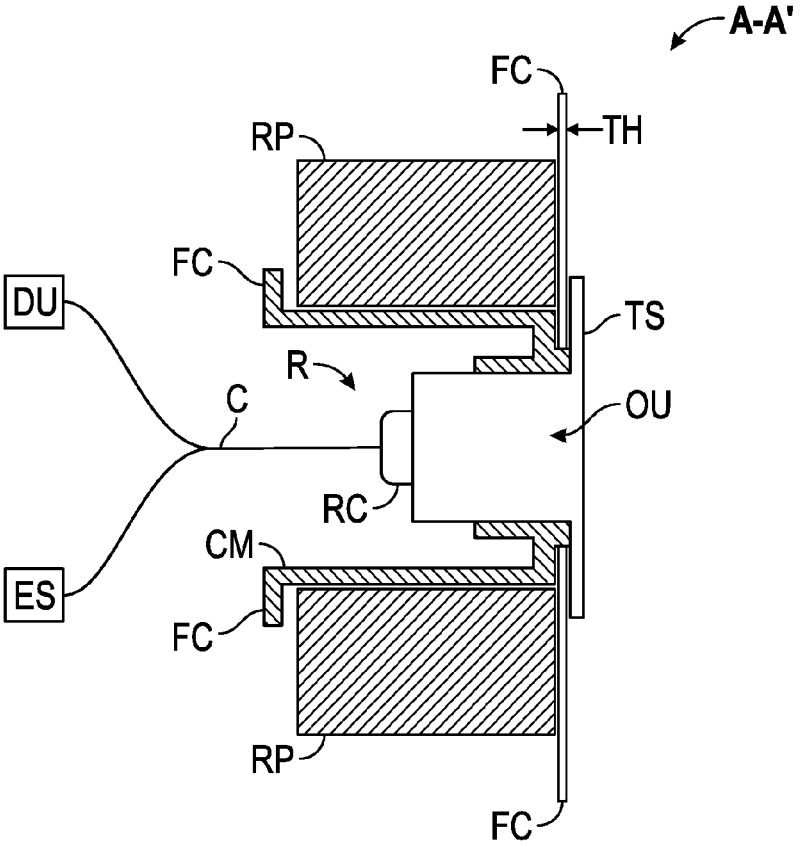
Figure 7:
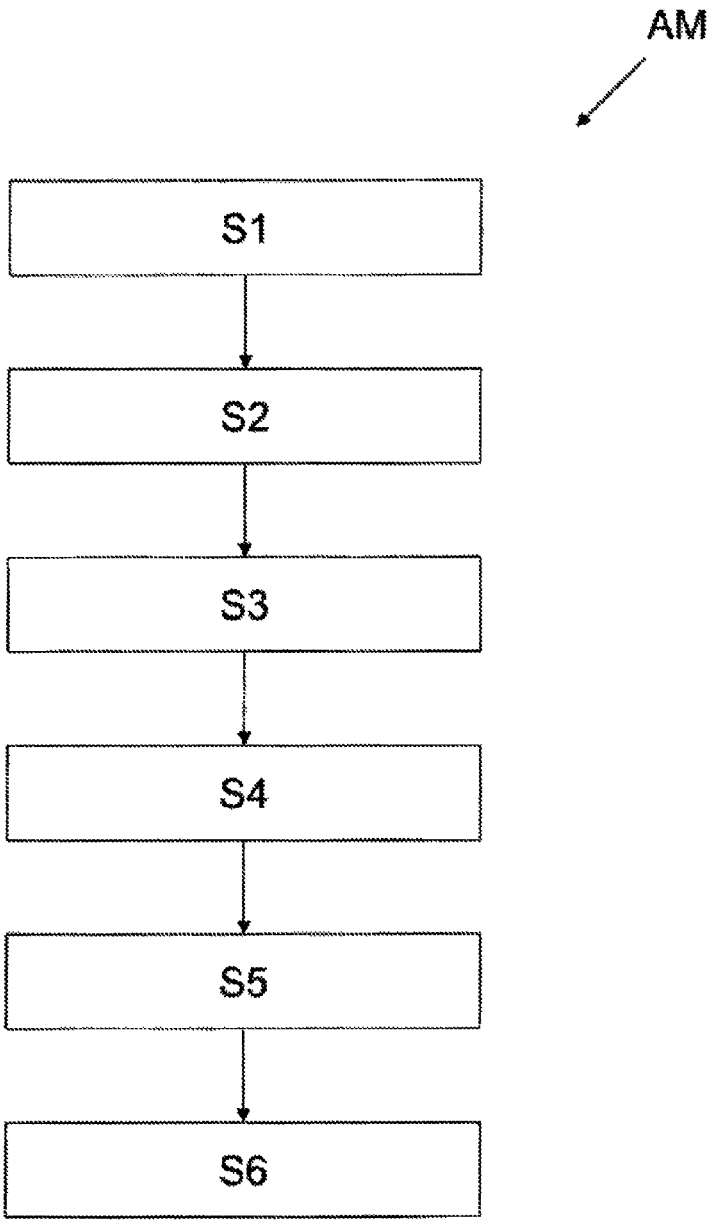

These are as follows:

FIG. 1 shows a schematic hand-switch arrangement with an operating unit and a carrier module, FIG. 2 shows the operating unit in a schematic view, FIG. 3 shows a schematic, sectional view of the carrier module, FIG. 4 shows a schematic, sectional view of the hand-switch arrangement, FIG. 5 shows a schematic view of an adjustable seating furniture with the hand-switch arrangement, FIG. 6 shows a schematic, sectional view of the seating furniture, and FIG. 7 shows a flow chart for the adjustable seating furniture with the hand-switch arrangement.

FIG. 1 shows an embodiment of a hand-switch arrangement HSA with an operating unit OU and a carrier module CM in a disassembled state. The hand-switch arrangement HSA according to FIG. 1 is designated to be fixedly connected to an adjustable seating furniture, such like a recliner. The operating unit OU is designated to be mechanically fixed to the carrier module CM.

The carrier module CM, which can be made of a metal material or plastics material, comprises a body part BP1 and a flange F. The carrier module CM is configured to be mounted to a rigid part of an adjustable seating furniture. The body part BP1 features a height H1, which for example is adjusted to a thickness of the rigid part. The carrier module CM further comprises bore holes BH, which are arranged on the flange F. The carrier module CM can be inserted into a recess of the rigid part of the adjustable seating furniture and can mechanically be fixed thereto by screws or other fixing means through the bore holes BH of the flange F. The flange F guarantees a mechanically safe and fix arrangement on rigid part of the seating furniture. Other joining technologies, for example adhesive bonding or gluing the flange F to the rigid part, are possible. In another alternative, the carrier module CM can also be stapled onto the rigid part of the seating furniture. In this case, the carrier module CM and/or the rigid part of the seating furniture may comprise stapling means, for example spring elements, which are known to a person skilled in the art.

In an alternative, it is also possible that the carrier module CM does not comprise a flange F and thus only the body part BP. Such a carrier module CM can be mechanically fixed to the rigid part in an alternative way. For example, such carrier module can comprise bore holes within the body part BP1 or the body part BP1 can be pressed into the recess of the rigid part, wherein the recess of the rigid part comprises smaller dimensions than the body part BP1.

The carrier module CM is designed to receive the operating unit OU, which can be inserted into an opening O of the carrier module. The operating unit OU comprises a body part BP2, whose dimensions are adapted to the dimensions of the opening O of the carrier module CM. The operating unit OU is inserted into the carrier module by a form-fit connection. To support the insertion, there may be arranged projections or guidings G engaging with counter parts, e.g. nuts, of the operating unit OU.

On a top side TS the operating unit OU comprises a control panel CP with control elements CE. In this embodiment, the control panel CP comprises a three-position switch, in particular a rocker switch. As shown in FIG. 1, the three-position switch is in a neutral position. By pushing one of the control elements CE the three-position switch can adopt two further switching positions. Within the operating unit OU there may be arranged micro switches or cherry switches, in order to detect the actuation of the control elements CE by a user. It is noted, that in this embodiment a very simple electrical arrangement is provided, in order that a complex control system can be avoided. Alternatively, additional electrical components like microprocessors or logic elements can be provided.

The control elements CE may comprise electrical lighting, in particular one or several LEDs. Such an electrical lighting, for example, can signal that the operating unit OU is correctly connected to an energy source. Such an electrical lighting can also signal to a user the position of the at least one control element CE, if the seating furniture is positioned in a dark environment. Also erroneous behavior of the seating furniture, for example a failure of the drive unit, can be signalized. Alternatively or additionally, such electrical lighting of one control element CE can be activated, when the control element CE is actuated by a user. For example, such a activated electric lighting can fade out, e.g. slowly, after being actuated, e.g. if the user stops actuating the control element CE.

The operating unit OU further comprises locking means LM1, which engage with mating locking means LM2 of the carrier module CM, when the operating unit OU is inserted into the opening O of the carrier module CM. In particular, the operating unit OU is inserted toolless. This is described in further detail with respect to FIGS. 3 and 4. In the described embodiments the locking means LM1 and LM2 are latching means, so that the locking means LM1 of the operating unit OU can snap in to the mating locking means LM2 of the carrier module CM. As can be seen in FIG. 1, the operating unit OU comprises two locking means LM1 at a front side and two further locking means LM1 at a back side, which is opposite to the front side (see FIG. 2). The locking means LM1 can be arranged close to each other (see FIG. 1) or can be arranged distantly (see FIG. 2). Other arrangements of the locking means LM1 or other embodiments of the locking means LM1 are possible and known to a person skilled in the art.

The operating unit OU further comprises a plug connecter PC at a bottom side, which is opposite to the control panel CP or the top side respectively. The plug connector PC is designed to be connected to both a drive unit and an energy source of the adjustable seating furniture, like a battery. Within the operating unit OU the control panel CP or the control elements CE respectively are electrically connected to the plug connector PC (not shown).

As can be seen in FIGS. 1 and 2, the operating OU comprises four locking means LM1. Alternatively, the operating unit OU can also comprise two locking means LM1, one at the front side and one on the back side. It has to be taken into account that the illustrated embodiment of the locking means LM1 is only exemplary. Other embodiments, for example by varying the dimensions of the locking means LM1, are possible. As can be seen in FIGS. 1 and 2, the locking means LM1 comprise several teeth T, which engage with a mating tooth MT of the mating locking means LM2 of the carrier module CM. This is described with respect to the FIGS. 3 and 4.

The control panel CP and thus the control element CE are surrounded by a flexible material FM, which can be made of elastic material such as elastomers. This helps getting an easy access to the locking means LM1 or mating locking means LM2, if the operating unit OU is inserted into the carrier module CM. In a not shown alternative, the control panel CP may not be surrounded by a flexible material, but by a stiff material, such as a polymer material.

The embodiment of the carrier module CM is not restricted to the embodiment shown in the Figures. Other forms and shapes of the body part BP1 or the flange F are possible. Analogous to that, the form or shape of the operating unit OU is not restricted to the one shown in the Figures.

FIG. 3 shows a schematic, sectional view of the carrier module CM as shown in FIG. 1. The mating locking means LM2 each comprise a mating tooth MT, which engage with one of the teeth T of the locking means LM1 of the operating unit OU. The operating unit OU can be inserted into the opening O of the carrier module CM without the need of additional tools, wherein a mounting depth of the operating unit OU is adjustable depending on which one of the tooth T of the operating unit OU is engaging. With respect to FIG. 4, when the operating unit OU is inserted into the opening O of the carrier module CM, the topmost teeth T of the locking means LM1 engage with the mating teeth MT of the mating locking means LM2 of the carrier module CM. Since the operating unit OU comprises several teeth T, a mounting depth is adjustable. For example the mounting depth is adjustable to a thickness of a fabric. Alternatively or additionally, it is also possible to account for production tolerances by adjusting the mounting depth.

Analogous to the locking means LM1 of the operating unit OU, the carrier module CM can comprise several mating locking means LM2, for example four mating locking means LM2.

The plug connector PC is designed to be electrically connected to both a drive unit of the adjustable seating furniture and an energy source for powering the operating unit. Thus, only one common cable respectively one single plug is necessary to connect the operating unit to the drive unit and energy source. Via the one cable, the operating unit OU can be powered. In the shown embodiment, the control panel CP is designed the directly provide a voltage from the energy source to the drive unit of the adjustable seating furniture, if the control panel respectively the control elements CE are actuated by a user. As described above, the control panel comprises a three-position switch, in particular a rocker switch, so that a rotating direction of the drive unit is adjustable. This allows that by actuating one of the control elements CE a voltage given by the energy source is directly switched to the drive unit.

The hand-switch arrangement HSA as described above allows an easy and flexible assembly and disassembly to an adjustable seating furniture without the need of tools. This is described in further detail below with respect to FIGS. 5 to 7. FIG. 7 shows an assembly method AM, which is described with the help of FIGS. 5 and 6.

FIG. 5 shows an exemplary, schematic view of an adjustable seating furniture SF. For example, the seating furniture SF can be a recliner, an armchair or a canvas chair. The seating furniture SF comprises a hand-switch arrangement HSA, according to one of the embodiments described above. The hand-switch arrangement HSA is arranged on and mechanically fixed to a rigid part RP of the seating furniture SF. The rigid part RP in the shown embodiment is a side part of the seating furniture SF and may exemplary be made of wood. The hand-switch arrangement HSA can also be fixed to an armrest of the seating furniture SF, wherein the armrest corresponds to the rigid part RP of the seating furniture SF. In another alternative, the hand-switch arrangement HSA can also be fixed to a console, which for example can be made of wood. The console may be arranged between two seating furnitures or two places of a seating furniture and may act as linking element of the two seating furnitures respectively places. The two seating furnitures respectively places can be seen as a unit. Such a unit may comprise more than two seating furnitures. The seating furniture SF further comprises an energy source ES and a drive unit DU, as schematically shown in FIG. 6. The drive unit DU may for instance be a linear actuator with a spindle. The seating furniture SF according to FIG. 5 can be covered by a fabric, for example a leather fabric. Alternatively, the seating furniture may not comprise a fabric. Such a seating furniture may only be made of wood and may therefore comprise a rigid part RP with a wooden surface.

FIG. 6 is a schematic, sectional view according to a cutting line A-A' in FIG. 5. The energy source ES can be a battery or a power supply connected to a mains voltage for providing a DC voltage. The drive unit DU can be an electric motor. The drive unit DU and the energy source ES are electrically coupled to the operating unit OU via one common cable C, which is plugged into the plug connector PC of the operating unit OU, preferably by a single plug. The carrier module CM is inserted into a recess R of the rigid part RP of the seating furniture SF. On an outside of the seating furniture SF a fabric FC is arranged. The fabric FC, which can be leather, textile or other fabric material, at least partially covers the carrier module CM and is arranged between the top side TS of the operating unit OU and the carrier module CM and/or the rigid part RP.

During production of the seating furniture SF according to the assembly method AM as shown in FIG. 7, the carrier module CM is inserted into the recess R of the rigid part RP of the seating furniture SF in a first step S1. The recess R of the rigid part RP is adapted to the dimensions of the body part BP1 of the carrier module CM, so that the carrier module CM can precisely be inserted.

In a next step S2, the carrier module CM is mechanically fixed to the seating furniture SF. As already described with regard to FIG. 1, this can be achieved by screwing the carrier module to the rigid part RP with screws through the bore holes BH. Alternatively, for example, if the carrier module CM does not comprise the flange F, the carrier module CM can be mechanically fixed to the rigid part RP by pressing the body part BP into the recess R of the rigid part, wherein the recess R of the rigid part RP comprises dimensions adapted to the body part BP, which are a little smaller. Other joining techniques for fixing the carrier module CM to the rigid part RP are possible, like adhesive bonding or stapling of the carrier module CM onto the rigid part RP as indicated above. The carrier module is fixed from inside of the seating furniture SF to the rigid part RP.

In a next step S3, the seating furniture SF is covered with the at least one fabric FC. The fabric FC is thereby covering the opening O of the carrier module CM (not shown). According to the material of the fabric FC it can be necessary to remove a portion of the fabric FC over the opening O of the carrier module CM. Alternatively, it may only be necessary to cut a slit into the fabric FC over the opening O.

In a next step S4, a plug of the common cable C, which is connected to both the drive unit DU and the energy source ES, is connected to the plug connector PC of the operating unit OU. The cable C with its plug can be led through the opening O from the inner of the seating furniture SF, in order to easier connect the cable C to the operating unit OU. Hence, a simple method to connect the operating unit OU to the drive unit DU and the energy source ES is achieved.

In a next step S5, the operating unit OU is inserted into the opening O of the carrier module CM.

In a next step S6, the operating unit OU is mechanically fixed to the carrier module CM such that a mounting depth of the operating OU is adjusted according to a thickness TH of the fabric FC. The mechanically fixing of the operating unit OU happens according to the description above. For example, the fabric FC can be made of leather, which generally has a higher thickness TH than a single-layer linen fabric. By fixing the operating unit OU to the carrier module CM, the fabric FC is also fixed mechanically to the rigid part RP and/or the carrier module CM, e.g. by friction locking In an alternative, the seating furniture SF may not comprise a fabric FC and may, for example, comprise a wooden surface, as indicated above. In this case, the operating unit OU may be arranged directly on the outer surface of the rigid part RP, e.g. the wooden surface, of the seating furniture, depending on the adjusted mounting depth of the operating unit OU. This allows to fix the operating unit OU by form-fit onto the rigid part RP, wherein there may be achieved no tolerance between the operating unit OU, e.g. the top side TS, and the rigid part RP.

With the given assembly method AM according to FIG. 8 an easy assembly method for inserting operating unit OU into the carrier module CM is given. Additionally, the operating unit OU can easily disassembled from the carrier module CM. This is explained with the aid of additional steps, which are not shown.

For disassembling the operating unit OU from the carrier module CM, the operating unit OU needs to be unlocked from the carrier module CM. For this purpose, the flexible material FM of the top side TS of the operating unit OU can be displaced, for example by a screw driver. With the help of the screw driver the engaged locking means LM1 and LM2 can be unlocked, so that the operating unit OU can be released from the carrier module CM. Afterwards, the operating unit OU can be unplugged from the cable C, so that the operating unit OU can be exchanged, for example due to a failure of the operating unit OU.

Alternatively, if the operating unit OU exemplary does not comprise a flexible material FM on the top side TS, the operating unit OU can be disassembled by pulling out the operating unit OU of the carrier module CM, thereby exerting a tension force to the operating unit OU.

The above described features or functions of the embodiments of proposed concept may be combined in any manner, in order to achieve the preferred advantages.

What is claimed is:

1. A hand-switch arrangement for an adjustable seating furniture corresponding to a recliner, the hand-switch arrangement comprising:

an operating unit and a separate carrier module, wherein the carrier module comprises a body part with an opening for accommodating the operating unit;

the carrier module is designed to be mechanically fixed to a rigid part of the adjustable seating furniture;

the operating unit comprises a body part, whose dimensions are adapted to the dimensions of the opening of the body part of the carrier module, and the operating unit comprises a control panel on a top side for controlling a drive unit of the adjustable seating furniture, wherein the control panel comprises a three-position switch for controlling the adjustable seating furniture, and wherein the body part has a height adjusted to a thickness of the rigid part; and within the operating unit the body part of the operating unit comprises a latching mechanism and the body part of the carrier module comprises a counter latching mechanism for engaging with the latching mechanism of the operating unit when the operating unit is inserted into the opening of the carrier module, such that a mounting depth of the operating unit is adjustable.

2. The hand-switch arrangement according to claim 1, wherein the latching mechanism comprises at least two teeth and the counter latching mechanism comprises at least one mating tooth for engaging with the at least two teeth, so that the mounting depth is adjustable.

3. The hand-switch arrangement according to claim 1, wherein the operating unit comprises a plug connector at an outer face, which is opposite to the control panel, wherein the plug connector is designed to be electrically connected to both the drive unit of the adjustable seating furniture and an energy source for powering the operating unit and the drive unit with a single plug.

4. The hand-switch arrangement according to claim 1, wherein the control panel is designed to directly provide a voltage from an energy source to the drive unit of the adjustable seating furniture, when the control panel is actuated.

5. The hand-switch arrangement according to claim 4, wherein the three-position switch corresponds to a rocker switch, so that a rotating direction of the drive unit is adjustable.

6. The hand-switch arrangement according to one of claim 4 or 5, wherein the control panel comprises at least one control element, wherein the at least one control element comprises electric lighting comprising one or several LEDs.

7. The hand-switch arrangement according to claim 1, wherein the control panel is surrounded by a flexible material comprising elastomer material.

8. The hand-switch arrangement according to claim 1, wherein the body part of the carrier module comprises a flange.

9. An adjustable seating furniture corresponding to a recliner, with a hand-switch arrangement according to claim 1, the seating furniture comprising an energy source corresponding to a battery or a power supply for providing a DC voltage, and the drive unit corresponding to an electric motor, which are arranged within the seating furniture and electrically coupled to the operating unit via one common cable, wherein the seating furniture comprises a recess in the rigid part, wherein the carrier module is inserted and to which the carrier module is mechanically fixed;

the operating unit is inserted into the opening of the carrier module and mechanically fixed thereto; and the mounting depth of the inserted operating unit is adjustable.

10. The adjustable seating furniture according to claim 9, further comprising:

at least one fabric for covering the seating furniture, wherein the opening of the carrier module is at least partially covered by the at least one fabric;

at least a portion of the at least one fabric is arranged at least partially between the operating unit and the carrier module; and the mounting depth of the inserted operating unit is determined by a thickness of the at least one fabric.

11. An assembly method for an adjustable seating furniture with a hand-switch arrangement according to claim 1, comprising the following steps:

inserting the carrier module into a recess of the rigid part of the seating furniture;

mechanically fixing the carrier module to the seating furniture;

inserting the operating unit into the opening of the carrier module; and mechanically fixing the operating unit to the carrier module such that the mounting depth the operating unit is adjustable.

12. The assembly method according to claim 11, wherein the seating furniture is covered with at least one fabric before inserting the operating unit into the opening of the carrier module, and wherein the mounting depth of the operating unit is determined by a thickness of the at least one fabric.

13. The assembly method according to claim 12, wherein an opening is provided in the at least one fabric over the opening of the carrier module, by cutting a slit into the at least one fabric or by removing a portion of the at least one fabric.

14. The assembly method according to one of claims 11 to 13, wherein a plug corresponding to a single plug, of a common cable, which is connected to both the drive unit and an energy source of the seating furniture, is connected to a plug connector of the operating unit before inserting of the operating unit into the opening of the carrier module.

15. The hand-switch arrangement according to claim 1, wherein the carrier module is fixed from inside of the seating furniture to the rigid part.

16. The hand-switch arrangement according to claim 1, wherein at least one fabric is mechanically fixed to the rigid part and/or to the carrier module by the operation unit.

17. The hand-switch arrangement according to claim 1, wherein the control panel comprises at least two control elements.

18. The hand switch arrangement according to claim 1, wherein the body part of the operating unit accommodates the control panel.

19. The hand switch arrangement according to claim 1, wherein the mounting depth is adjustable independent from an actuation of the control panel or the three-position switch respectively.

20. The hand switch arrangement according to claim 1, wherein the latching mechanism of the body part of the operating unit engages the counter latching mechanism of the body part of the carrier module independent from the control panel or the three-position switch respectively.

* * * * *